US006405469B1

(12) United States Patent
Walsh

(10) Patent No.: US 6,405,469 B1
(45) Date of Patent: Jun. 18, 2002

(54) TRIGGER LOCK

(76) Inventor: Michael J. Walsh, 5724 Aluffo Rd., Paso Robles, CA (US) 93446

( * ) Notice: Subject to any disclaimer, the term of this patent is extended or adjusted under 35 U.S.C. 154(b) by 0 days.

(21) Appl. No.: 09/557,817

(22) Filed: Apr. 25, 2000

(51) Int. Cl.[7] ..... F41A 17/00
(52) U.S. Cl. ..... 42/70.07; 42/70.01
(58) Field of Search ..... 42/70.06, 70.07, 42/70.11, 70.01

(56) References Cited

U.S. PATENT DOCUMENTS

| | | | | | |
|---|---|---|---|---|---|
| 3,624,945 | A | * | 12/1971 | Foote | 42/1 |
| 4,499,681 | A | * | 2/1985 | Bako et al. | 42/1 |
| 5,561,935 | A | * | 10/1996 | McCarthy et al. | 42/70.07 |
| 5,638,627 | A | * | 6/1997 | Klein et al. | 42/70.07 |
| 5,832,647 | A | * | 11/1998 | Ling et al. | 42/70.07 |
| 5,899,102 | A | * | 5/1999 | Ling | 70/312 |
| 6,009,654 | A | * | 1/2000 | Williams et al. | 42/70.11 |
| 6,205,695 | B1 | * | 3/2001 | Schnell | 42/70.07 |
| 6,209,251 | B1 | * | 4/2001 | Avganim | 42/70.07 |
| 6,269,575 | B1 | * | 8/2001 | Chang | 42/70.07 |

* cited by examiner

*Primary Examiner*—Charles T. Jordan
*Assistant Examiner*—Kimberly S. Smith

(57) ABSTRACT

In a clamshell-type trigger lock for a firearm of the type including a first clamshell element, an openable lock extending inward, and a stub extending from the lock wherein the stub has a plurality of transverse teeth formed thereon in a narrow planar path therealong, a second clamshell element, a bore, and a latch having a plurality of transverse teeth formed along the under surface portion of the latch, the latch arranged for slight upward movement against a bias during insertion of the stub in the bore, where the teeth on the stub pass over the teeth on the latch, for later interlocking mating engagement when the first and second clamshell elements are positioned on opposite sides of the trigger and trigger housing of a firearm and the stub is passed between the trigger and the trigger housing of the firearm and inserted in the bore to allow the teeth on the latch to engage the teeth on the stub, first and second: rubber gaskets, one each placed along the inner surface of each the first and second clamshells, for placement against the firearm to reduce the contact between the first and the second clamshell elements and the firearm, the improvement in preventing unauthorized unlocking of the trigger lock, the improvement comprising solid means for covering the partially exposed portion of the latch and preventing contact from outside objects penetrating the area between the first and the second clamshell elements.

9 Claims, 7 Drawing Sheets

TRIGGER LOCK

This invention relates to the firearms industry. More particularly, it relates to an improved firearm trigger lock that prevents the lock from being opened without permission.

BACKGROUND OF THE INVENTION

DESCRIPTION OF THE PRIOR ART

If one defines the term "firearm" as a weapon held at the shoulder or in the hand and fired by squeezing a trigger, then all pistols (handguns) and rifles are considered firearms. Firearms have certain related features, and the one feature dealt with in this patent centers around the trigger, that little device defined in the dictionary as "a small lever pressed back by the finger to activate the firing mechanism." Many people are severely injured or killed by firearms each year. Efforts have been made to have people register firearms, to take them is out of the reach of children, and to forbid ownership of them altogether. All without apparent success. At present, the most effective means of rendering-firearms safe is to lock the firing mechanism against accidental or unauthorized activation.

One of the most common means of securing the trigger in an inoperative condition is by locking the trigger against movement using a trigger lock. The most popular of these mechanisms is a two-piece "clamshell-type" lock where the clamshells engage opposite sides of the trigger and trigger housing, with a shaft or stub passing from one clamshell to the other clamshell behind the trigger and inside the trigger housing to prevent rearward movement of the trigger. Rubber gaskets are located on each clamshell to prevent damage to the firearm. The clamshells are not truly clamshells because they are totally independent from each other instead of being interconnected through a hinge. The clamshells are placed on opposite sides of the trigger housing, (that circular-type piece of metal that surrounds most of the exposed portion of the trigger) and pushed together while the stub extends from one clamshell, behind the trigger and through the trigger housing, into a bore formed in the other clamshell and wherein the stub has a series of teeth formed along one axial path for joinder with a latch, mounted in the bore in the opposite clamshell and having a series of teeth formed thereunder, so that the teeth on the latch and the teeth on the stub engage under bias pressure to lock the two clamshells together about and through the trigger and trigger housing. Once in place, the trigger cannot be moved rearward thus locking the firearm in a safe condition. The lock is unlocked by either inserting a key in the key slot allowing the stub to be turned and rotating the teeth thereon out of engagement with the teeth on the latch or setting a proper combination on lock dials and pressing the lock release thus allowing the two clamshells to be pulled apart.

Recently, it was discovered that many of these clamshell-type trigger locks could be easily removed from a firearm without using a key or the combination. Referring to FIG. 1, it can be seen that screwdriver A, having a narrow diameter shaft B, and a narrow flat blade C, can be inserted between one of two clamshells D and E and the associated rubber gasket G and pushed to extend the blade into contact with the latch. Slight movement, such as twisting of the screwdriver blade, will lift the latch F, as shown in dotted outline, against its bias allowing the teeth to disengage just enough that the two clamshells can be pulled apart. The trigger lock remains in the locked position, however, it is now removed from the firearm allowing the firearm to be discharged upon pulling the trigger.

SUMMARY OF,THE INVENTION

This invention is an improvement in the traditional clamshell-type trigger lock in order to render it and the firearm on which it is used impervious to unwanted release as described above. The invention comprises means for preventing the partially exposed portion of the latch from contact from outside objects penetrating the lock and otherwise preventing access to the latch. One embodiment of the invention is to impose a cover over top of the latch preventing contact from any object inserted in the lock from above the latch. Another embodiment is to provide the cover and to round off the "foot" of the latch to prevent anyone from prying the latch upward from its normally pointed nose at the front of the latch. Another embodiment is to reverse the latch so that it extends into the bore instead of extending from it. A still further embodiment of the invention is to provide a collar, extending from the wall of the bore, that effectively covers the exposed foot of the latch thus preventing contact therewith from any object inserted into the lock from any direction.

Accordingly, the main object of this invention is a means to prevent undesired access to a trigger lock, such as by prying up the latch in the clamshell-type trigger lock and removing the lock from the firearm, so as to use the firearm without permission of the owner. Other objects of the invention include a means for making the lock impenetrable to unauthorized entry; a way to retro-fit a clamshell-type trigger lock to make it far more security-proof than is possible before this invention; a means of safely treating a firearm so that it cannot be used by unauthorized personnel; and, a means of making firearms child-proof.

These and other objects of the invention will become more clear when one reads the following specification, taken together with the drawings that are attached hereto. The scope of protection sought by the inventor may be, gleaned from a fair reading of the Claims that conclude this specification.

DESCRIPTION OF THE PREFERRED EMBODIMENTS

Figure 2:
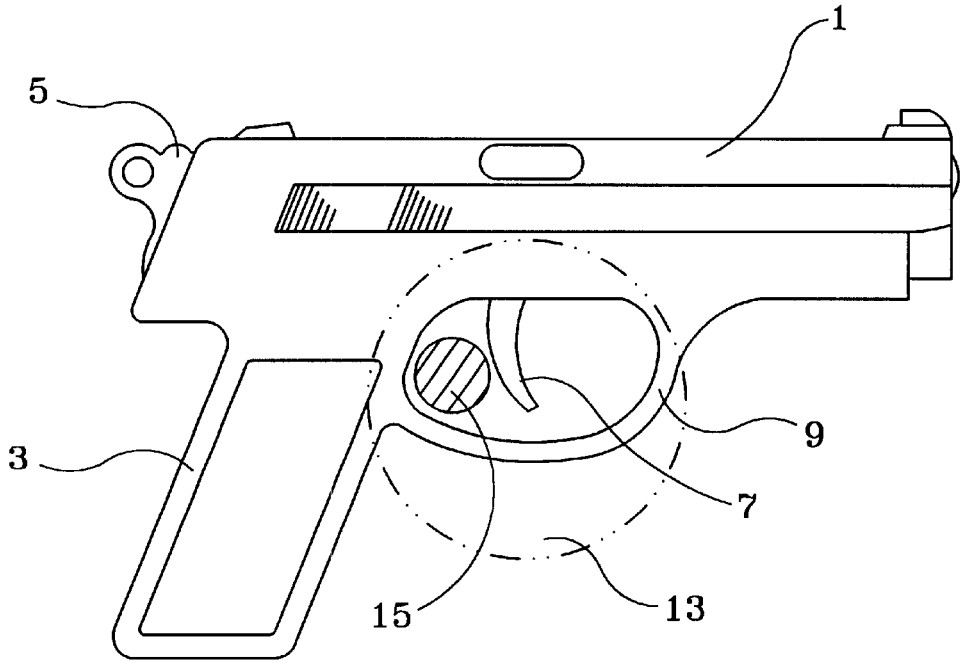
FIG. 2 is a side view of a typical handgun showing its parts and where the typical trigger lock is located on the handgun.

Turning now to the drawings, where elements or limitations are identified with numerals, and like elements or limitations are identified with like numerals throughout the thirteen figures, FIG. 2 shows a typical handgun comprising, in general, a barrel 1, supported on a handle 3, a firing mechanism 5 located at the rear of the barrel, and a trigger 7 that will cause the gun to discharge when pulled rearward in the trigger guard 9. Shown in dotted outline is the rear or back side of a typical two-piece, clamshell-type trigger lock 13 located over trigger 7 and trigger guard 9 that prevents rearward movement of trigger 7 by the imposition of a stub 15 behind trigger 7 at the rear of trigger guard 9.

Figure 1:
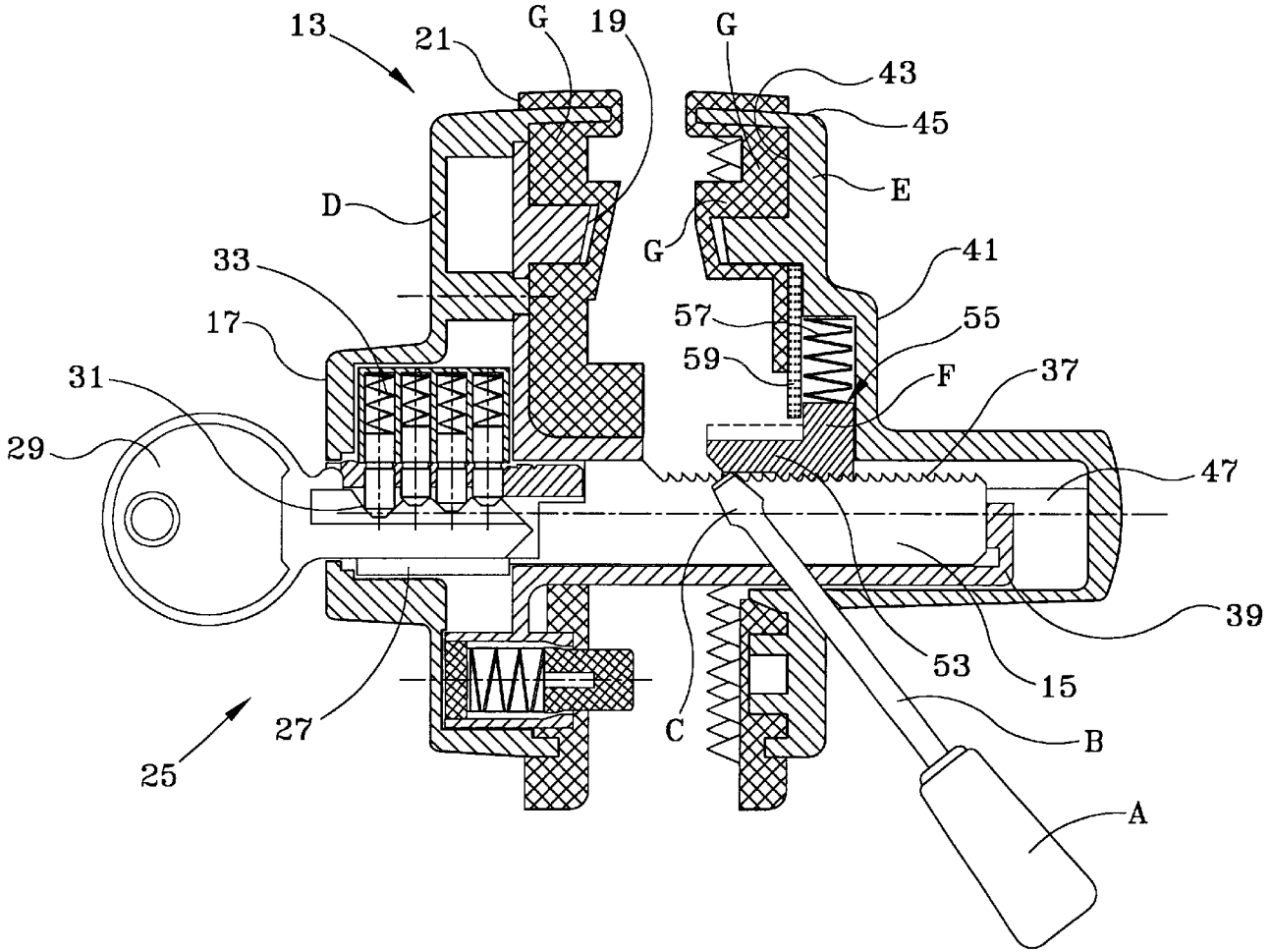
FIG. 1 is a sectional side view of a typical clamshell-type trigger lock showing how access may be had to open the lock without using the lock keys.

Referring to FIG. 1, trigger lock 13 comprises a first clamshell element D defined by a stylized, pebble finished outer surface 17, an opposite, machined inner surface 19, and a somewhat oval-shaped periphery 21. First clamshell element D, as well as a second clamshell element hereinafter introduced, are preferably made of cast metal.

An openable key lock 25 extends inward from outer surface 17 and includes a rotatable key barrel 27, pivotally housed therein for receipt of a key 29 in a key slot 31, formed therein, and a plurality of spring-loaded tumblers 33 arranged for contact with an edge of the key for alignment to allow the key and key barrel to be pivotally turned in said lock. A combination lock may be substituted for lock 25 and is fully contemplated in this invention. When so used, said combination lock is often accompanied with an expose button that is pressable from outside the lock and which results in stub 15 being depressed out of contact with a latch located in the opposite clam shell element to open the lock. . . 15 is substantially cylindrical in design and extends from lock 13 and inner surface 19, on the side of lock 25 opposite key 29, and has a plurality of transverse, angled teeth 37 formed thereon in a narrow planar path therealong. Stub 15 is housed on the bottom, sides, and free end by a cylindrically-shaped cradle 39 so that only its uppermost surface is exposed.

Figure 3:
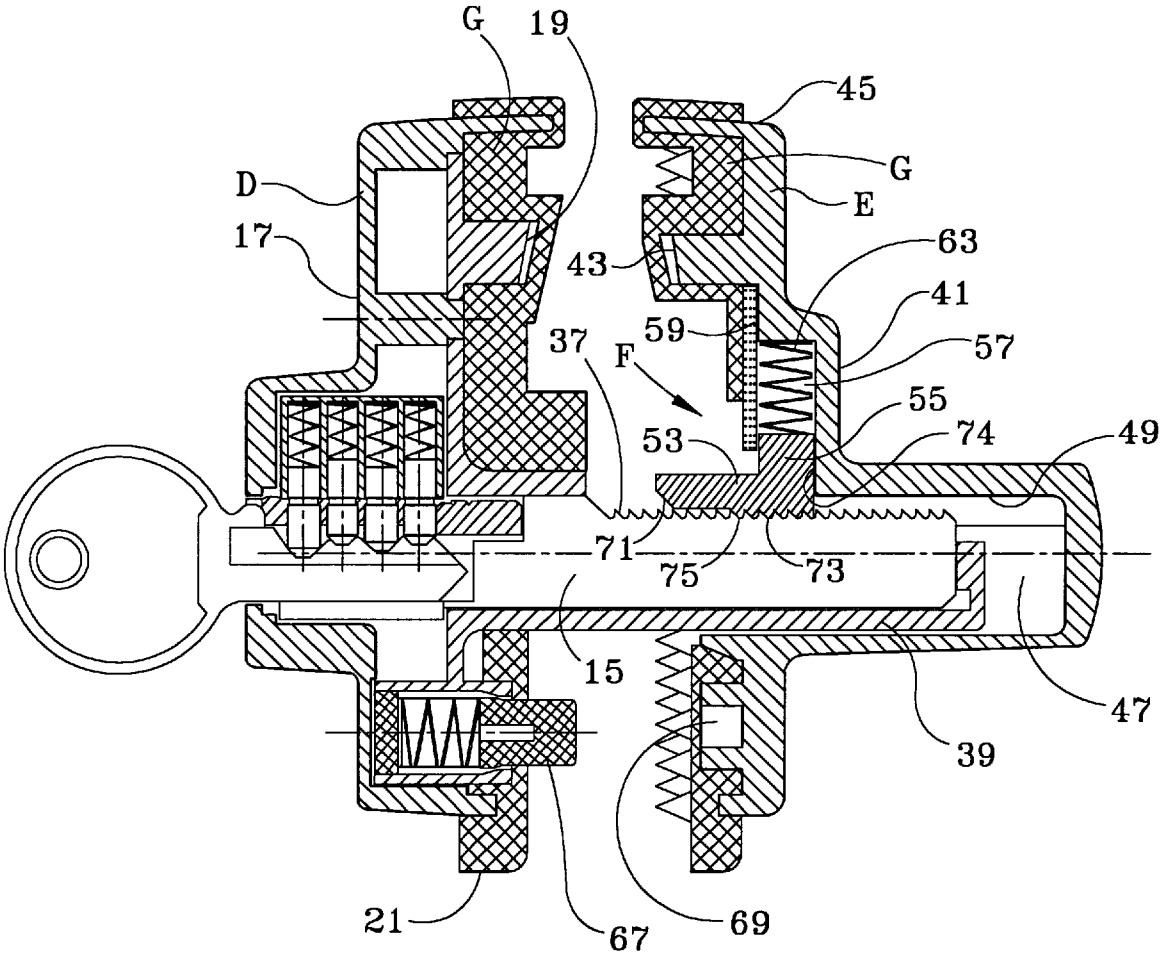
FIG. 3 is a sectional side view of a clamshell-type trigger lock showing the internal parts and how they interact with each other.
Figure 4:
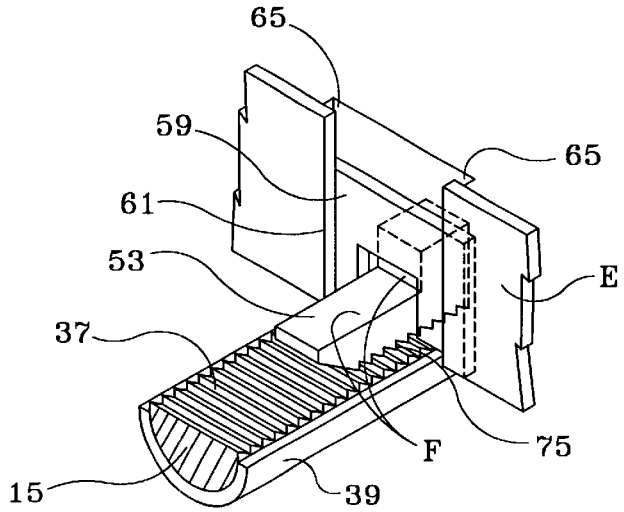
FIG. 4. is a close-up perspective view of a portion of the internal elements of the trigger lock and the engagement of the stub with the latch foot.

As shown in FIG. 3, a second clamshell element E is provided and is defined by an outer surface 41, similar to outer surface 17, an inner, opposite surface 43, a perimeter 45 matching that of perimeter 21, and a bore 47, including a bore wall 49, formed inward from inner surface 43 and axially aligned opposite stub 15 and cradle 39. A latch F, defined by a latch foot 53 and a latch post 55 extending from said latch foot, is mounted in a cavity 57 formed in second element E and partially covered over by a planar cover 59 that is generally parallel with the surrounding inner surface 43 of clamshell element E. Bias means, such as a small coil spring 63, is housed in cavity 57, on top of latch post 55, for the purpose of biasing latch foot 53 downward toward the interior of bore 47. As shown in FIG. 4, cover 59 is generally non-removable in nature being held in place in a pair of opposed slots 65 formed in second clamshell element E. As shown in FIG. 3, one or more pegs 67 are formed on either first element inner surface 19 or second element inner surface 43 and extend outward from the element inner surface to span the distance between first and second clamshell elements, D and E, and enter a detent 69 formed in the opposite inner surface so that, when assembled, first and second clamshell elements are locked in place and unwanted twisting of one clamshell element with respect to the other is eliminated.

As shown in FIGS. 3 and 4, latch F. is preferably L-shaped and said latch foot 53 includes an undercut 71, and an underfoot surface 73 positioned along a cutout 74 in bore wall 49 and has formed thereon a plurality of transverse, angled teeth 75 and is arranged for movement, under bias pressure, toward and away from the interior of bore 45 and, when biased toward the interior of bore 45, into engagement with teeth 37 formed on stub 15. The opening 61 in cover 59 allows a slight upward movement of latch F, when first and second clamshell elements D and E are pushed together from opposite sides of a firearm trigger housing and stub 15 is passed behind the firearm's trigger 7 and into bore 45, to allow teeth 37 and 75 to bump and ride over each other.

Once trigger lock 13 is in position on the firearm, however, angled teeth 37 and 75 come into interlocked engagement, as shown in FIG. 1, and do not allow release of one another or the release of element D from attachment-with element E. To unlock trigger lock 1, one merely inserts the appropriate key 29 into key slot 31, thus aligning tumblers 33, and turns key 29 so that stub 15 rotates in cradle 39 and teeth 37 are rotated out of interlocking engagement with teeth 75 on latch foot 53 thereby allowing the two clamshell elements to be parted. When using a combination lock, the dials are set to the proper combination and the button is pressed to depress or rotate stub 15 out of interlocked engagement with latch foot 53.

Also provided are first and second rubber gaskets G and G respectively, one each placed along inner surfaces 19 and 43 of each of said first and second clamshells D and E, for placement against the firearm to reduce the contact between metallic first clamshell element D and the firearm and between metallic second clamshell element E to prevent scratching of either metal part.

As can be seen in FIGS. 3 and 4, latch F of prior art trigger locks contains latch foot 53 and it must be elongated to accommodate sufficient angled teeth 75 to insure solid interlocking engagement between teeth 37 on stub 15 and teeth 75 on latch underfoot surface 73. This elongation is directed outward from second clamshell element inner surface 43. This invention is a means to thwart an intruder from slipping a narrow diameter screw driver blade and shaft, or the like, between second clamshell element inner surface 43 and rubber gasket G and twisting the blade to raise the front part of latch foot 53 out of contact with stub 15 thereby allowing the two clamshell pieces to be pulled apart without turning the lock.

Figure 5:
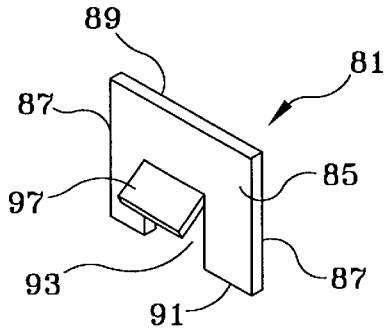
FIG. 5 is a close-up perspective view of one embodiment of the invention.
Figure 6:
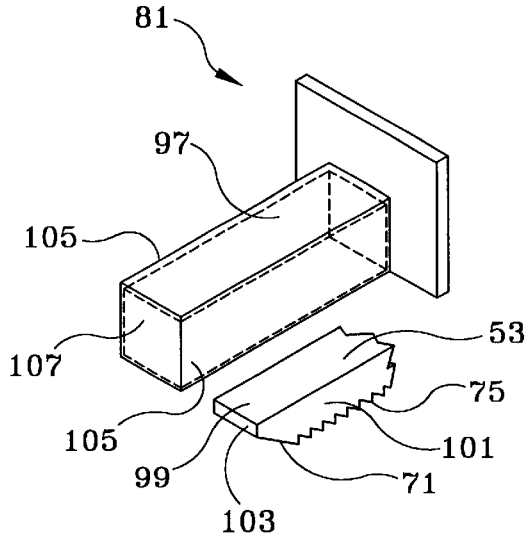
FIG. 6 is a close-up perspective view of another embodiment of the invention.

As shown in FIG. 5, the first embodiment of the invention comprises a cover 81 over the exposed portion of latch foot 53. Cover 81 comprises a main planar cover plate 85, defined by a pair of spaced-apart side edges 87, a top edge 89, a bottom edge 91 having a central cutout portion 93 formed therein, for passage of latch foot 53 therethrough, and a shield plate 97, extending outward from above cutout portion 93 and preferably orthogonal from the plane of cover plate 85 and of a length such as to terminate no less than the full exposed length of latch foot 53. Where latch F is additionally defined by a partially exposed latch foot top surface 99, latch foot opposed side surfaces 101 and a latch foot front surface 103, cover 81 may take on a separate embodiment, as shown in FIG. 6 where a pair of spaced-apart side shield plates 105 and a front shield plate 107 are added between the outside edges of shield plate 97 and the edges of cover cutout portion 93 to protect the side walls 101 and front wall 103 of latch foot 53 from contact with foreign objects.

Figure 7:
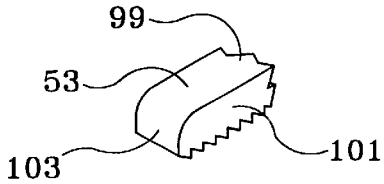
FIG. 7 is a close-up view of a latch foot modified according to the teachings of this invention.

In another embodiment of this invention, as shown in FIG. 7 foot top surface 99 is rounded to remove undercut 71 and to make front surface 103 orthogonal to the plane of underfoot surface 73 thus depriving anyone the ability of using the undercut 71 of latch foot 53 as a hold for a pry bar.

Figure 8:
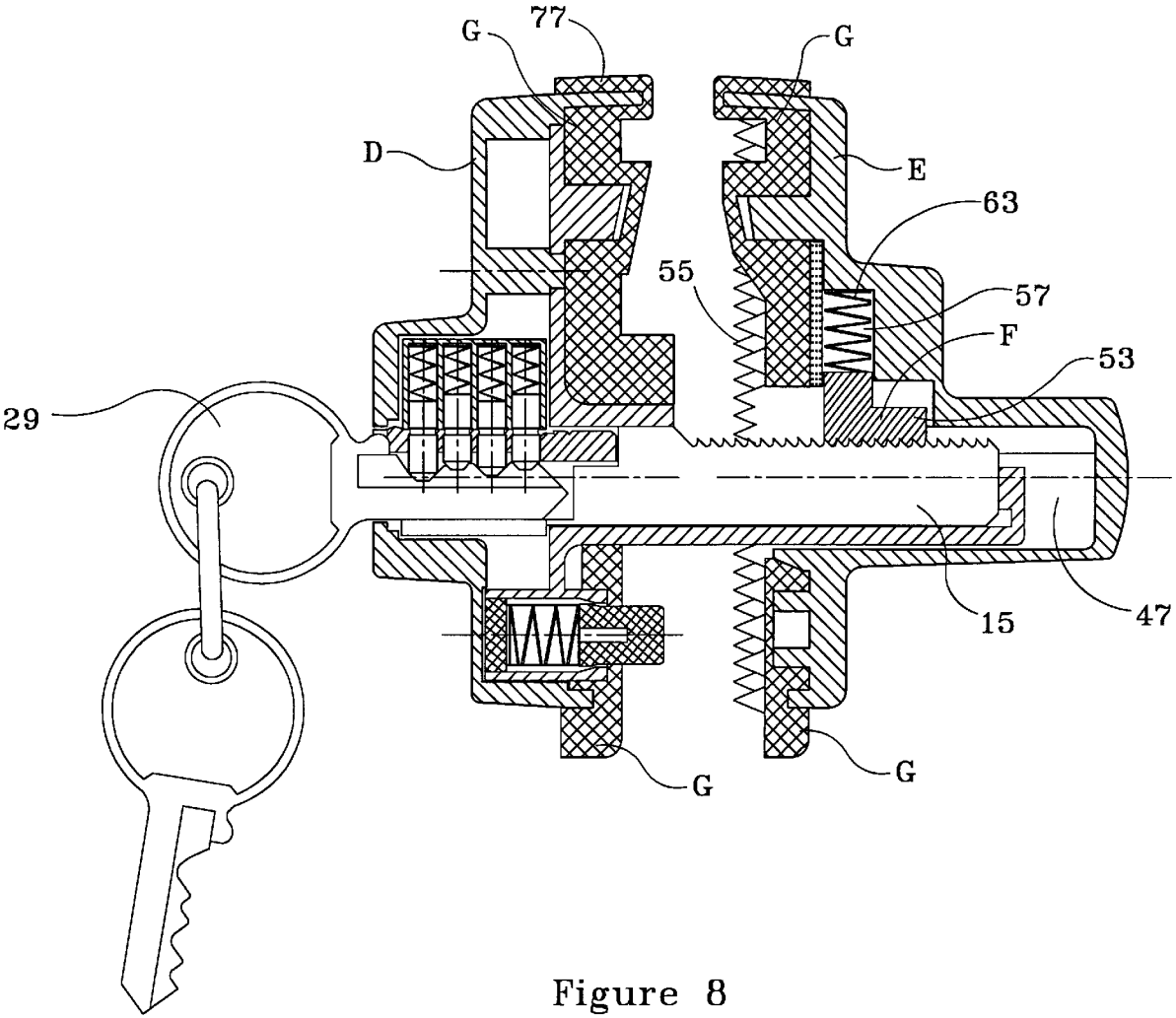
FIG. 8 is a sectional side view of another embodiment of the invention.

A still further embodiment of this invention is shown in FIG. 8 where the position of latch 53 is reversed or turned 180° so that it extends from cavity 57 into bore 47 thus removing any part of latch foot 53 to show or extend outward from second clamshell inner surface 43.

Figure 10:
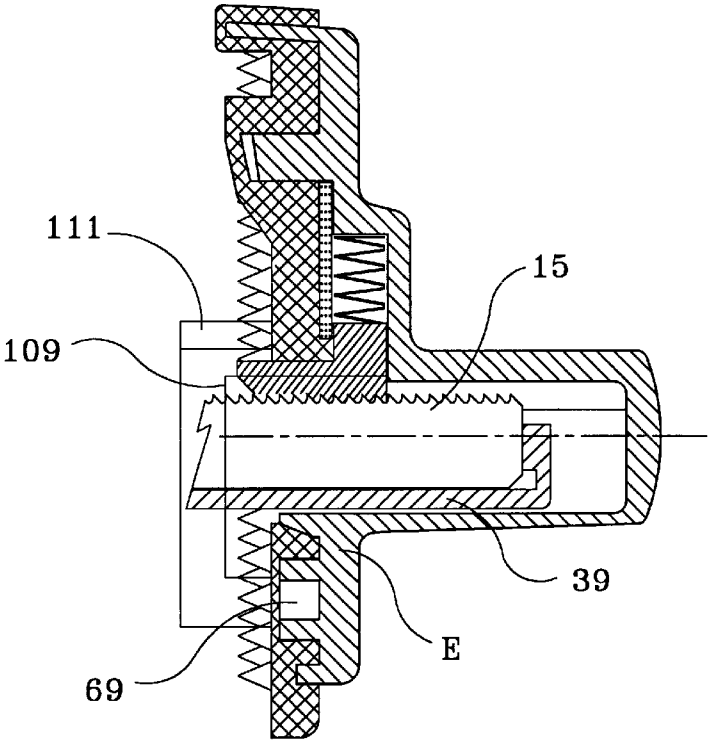
FIG. 10 is a side view of the embodiment shown in FIG. 9.
Figure 9:
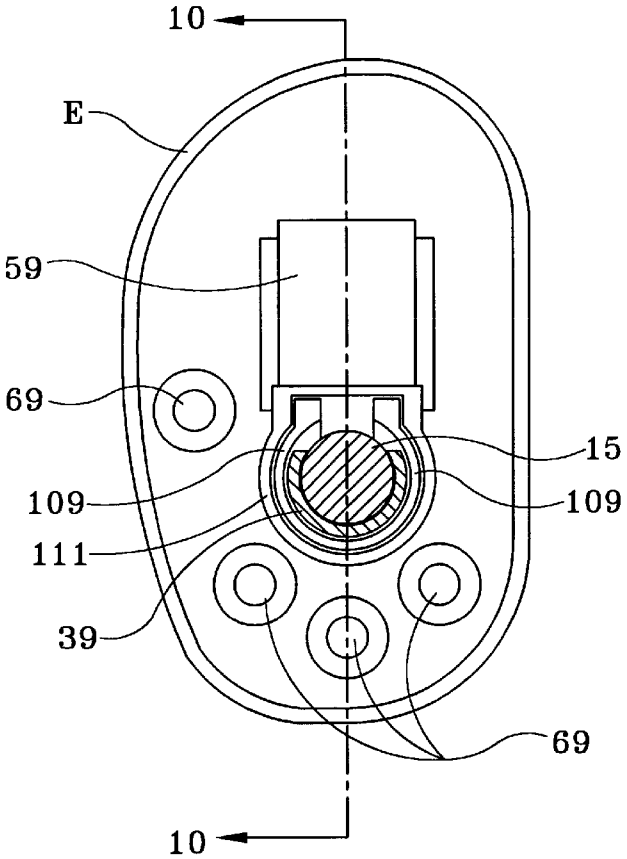
FIG. 9 is a rear elevation view of one of the clamshell elements showing another embodiment of the invention.
Figure 11:
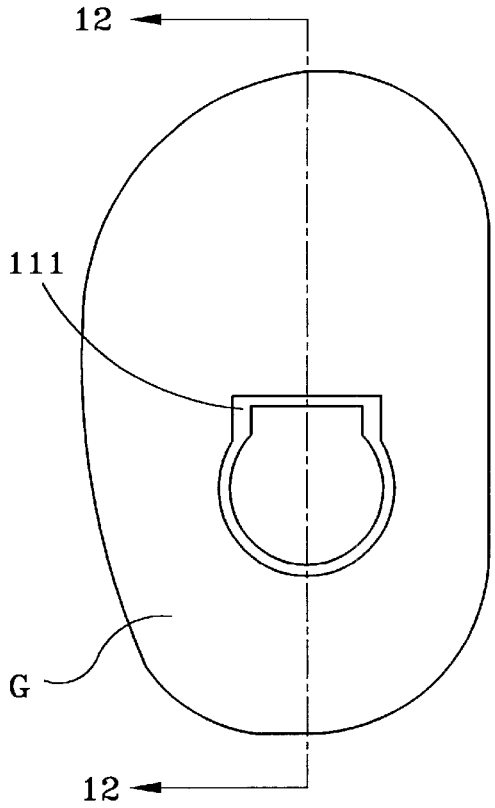
FIG. 11 is a front view of one of the gaskets that is placed over one of the clamshell elements of the trigger lock of this invention.
Figure 12:
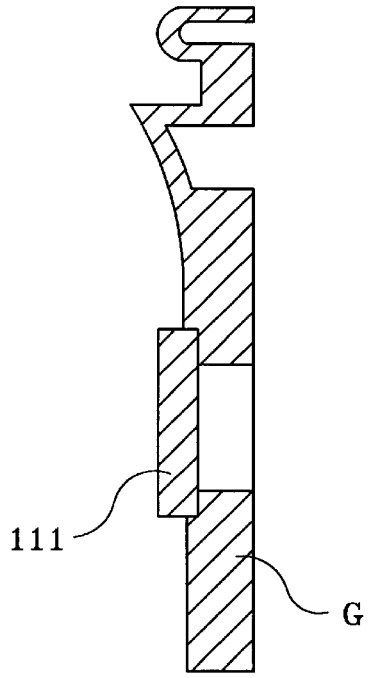
FIG. 12 is a sectional side view of the gasket that is shown in FIG. 11; and, FIG. 13 is a perspective view of another embodiment of the invention where the shield plate anchored on the cover is extended to form a front wall over the latch foot.

A still further embodiment of this invention is shown in FIGS. 9, and 10 where a collar 109 is formed on second clamshell element inner face 43, said collar 109 extending from bore wall 49 outward to encompass the total length of latch foot 53 to shield it from contact with an instrument inserted between second clamshell element E and gasket G. FIGS. 11 and 12 show this embodiment where an extended rubber collar 111 is provided in gasket G for surrounding metal collar 109 to aid in preventing access to latch F from outside trigger guard 13.

Figure 13:
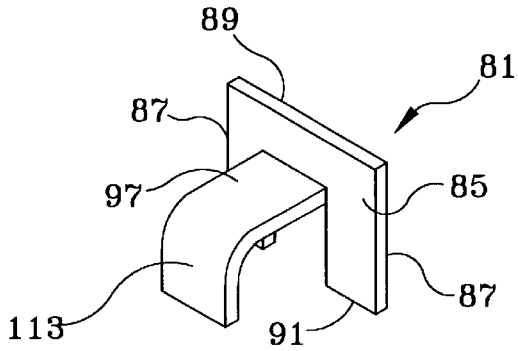

A still further embodiment of this invention is shown in FIG. 13 wherein a front wall 113 is added to shield plate 97 to extend outward and downward over the front of latch foot 53 to terminate at or near the plane of latch foot 53 to protect it from being pried upward by a blade inserted as shown in FIG. 1.

While the invention has been described with reference to a particular embodiment thereof, those skilled in the art will be able to make various modifications the described embodiment of the invention without departing from the true spirit and scope thereof. It is intended that all combinations of members and steps which perform substantially the same function. in substantially the same way to achieve substantially the same result are within the scope of this invention.

What is claimed is:

1. A clamshell-type trigger lock, for a firearm of the type having a trigger and a surrounding trigger guard, comprising:

a) a first clamshell element defined by an outer surface, an opposite inner surface, an openable lock extending inward from said outer surface, and a stub extending inwardly from said lock and said inner surface wherein said stub has a plurality of transverse teeth formed thereon in a narrow planar path therealong;

b) a second clamshell element defined by an outer surface, an opposite inner surface, a bore including a bore wall formed inward from said inner surface, and a latch reciprocally mounted in said second clamshell element and partially exposed from said inner surface thereof, said latch including an under surface portion positioned along said bore wall and biased for movement toward the interior of said bore and having a plurality of transverse teeth formed along said under surface portion of said latch, said latch arranged for slight upward movement against said bias, during insertion of said stub in said bore, wherein said teeth on said stub pass over said teeth on said latch, for later interlocking mating engagement therebetween when said first and second clamshell elements are positioned on opposite sides of the trigger and trigger guard of a firearm and said stub is passed between the trigger and the surrounding trigger guard of the firearm and inserted in said bore to allow said teeth on said latch to engage said teeth on said stub; and, c) protective means for covering said partially exposed portion of said latch to prevent contact with said latch from outside the trigger lock wherein said protective means comprises:

i) a main planar cover plate parallel to said inner surface of said second clamshell element, said cover plate defined by a pair of spaced-apart side edges for planar receipt in spaced-apart slots formed in said second clam shell element inner surface, a top edge and a bottom edge having a central cut-out portion formed therein; and, ii) a shield plate extending outward from above said cut-out portion to shield said latch foot from being pried upward and out of contact with said stub.

2. A clamshell-type trigger lock, for a firearm of the type having a trigger and a surrounding trigger guard, comprising:

a) a first clamshell element defined by an outer surface, an opposite inner surface, an openable lock extending inward from said outer surface, and a stub extending inwardly from said lock and said inner surface wherein said stub has a plurality of transverse teeth formed thereon in a narrow planar path therealong;

b) a second clamshell element defined by an outer surface, an opposite inner surface, a bore including a bore wall formed inward from said inner surface, and a latch reciprocally mounted in said second clamshell element and partially exposed from said inner surface thereof, said latch including an under surface portion positioned along said bore wall and biased for movement toward the interior of said bore and having a plurality of transverse teeth formed along said under surface portion of said latch, said latch arranged for slight upward movement against said bias, during insertion of said stub in said bore, wherein said teeth on said stub pass over said teeth on said latch, for later interlocking mating engagement therebetween when said first and second clamshell elements are positioned on opposite sides of the trigger and trigger guard of a firearm and said stub is passed between the trigger and the surrounding trigger guard of the firearm and inserted in said bore to allow said teeth on said latch to engage said teeth on said stub; and, c) protective means for covering said partially exposed portion of said latch to prevent contact with said latch from outside the trigger lock wherein said protective means comprises:

i) a main planar cover plate defined by a pair of spaced-apart side edges for receipt in spaced-apart slots formed in said second clamshell element inner surface, a top edge and a bottom edge and having a central cut-out portion formed therein;

ii) a shield plate extending outward from above said cut-out portion and defined by a pair of spaced-apart side edges; and, iii) a pair of spaced-apart side shield plates extending downward from said shield plate side edges to cover all visible portions of said latch foot and shield it from contact with a foreign object.

3. A clamshell-type trigger lock for a firearm of the type having a trigger and surrounding trigger guard comprising:

a) a first clamshell element defined by an outer surface, an inner surface, an openable lock extending inward from said outer surface, and a stub extending from said lock and from said inner surface, and terminated by a free end, wherein said stub has a plurality of transverse teeth formed thereon in a narrow planar path therealong;

b) said stub housed on the bottom, sides, and free end by a cylindrically-shaped cradle so that only the uppermost surface of said stub is exposed;

c) a second clamshell element defined by an outer surface, an inner surface, a bore including a bore wall formed inward from said inner surface; and, d) a latch, including a latch foot having a flat foot undersurface and a latch post extending from said latch foot, reciprocally mounted in said clamshell second element and partially exposed from said inner surface of said second clamshell element, having a portion thereof positioned along said bore wall and biased for movement toward the interior thereof and having a plurality of transverse teeth formed along said flat foot undersurface portion of said latch, said latch further defined by a latch foot top surface, opposed side surfaces and a latch foot front surface all said surfaces defined by marginal edges meeting at their points of intersection, said latch arranged for slight upward movement against said bias during insertion of said stub in said bore, where said teeth on said stub pass over said teeth on said latch, for later interlocking mating engagement when said first and second clamshell elements are positioned on opposite sides of the trigger and surrounding trigger guard and said stub is passed between the trigger and the trigger guard of the firearm and inserted in said bore to allow said teeth on said latch to engage said teeth on said stub;

e) said latch foot top surface being curved in a smooth radius to said latch foot front surface so that said latch foot front surface meets said latch foot undersurface orthogonally to prevent the front of said latch foot from being used as a prying location by a foreign object.

4. The clamshell-type trigger lock of claim 3 further including first and second gaskets, one each placed over said inner surface of each said first and said second clamshells, for contact with the firearm to reduce the potential for scratching contact between said first and said second clamshell elements and said firearm.

5. The clamshell-type trigger lock of claim 3 further including a cover over said exposed portion of said latch, wherein said cover comprises:

a) a main planar cover plate defined by a pair of spaced-apart side edges for receipt in spaced-apart slots formed in said second clam shell element inner surface, a top edge and a bottom edge having a central cut-out portion formed therein; and, b) a shield plate extending outward from above said cut-out portion to shield said latch foot from being pried upward and out of contact with said stub.

6. The clamshell-type trigger lock of claim 3 wherein said openable lock is a key-operated lock that, when unlocked, allows said stub to be rotated in said cradle to move said teeth out of engagement with said teeth on said latch foot.

7. The clamshell-type trigger lock of claim 3 wherein said openable lock is a combination lock that, when unlocked, allows said stub to be depressed in said cradle to separate said teeth from engagement with said teeth on said latch foot.

8. The clamshell-type trigger lock of claim 5 wherein said shield plate is orthogonal to the plane of said main planar cover plate.

9. A clamshell-type trigger lock for a firearm of the type having a trigger and surrounding trigger guard comprising:

a) a first clamshell element defined by an outer surface, an inner surface, an openable lock extending inward from said outer surface, and a stub extending from said lock and from said inner surface, and terminated by a free end, wherein said stub has a plurality of transverse teeth formed thereon in a narrow planar path therealong;

b) said stub housed on the bottom, sides, and free end by a cylindrically-shaped cradle so that only the uppermost surface of said stub is exposed;

c) a second clamshell element defined by an outer surface, an inner surface, a bore including a bore wall formed inward from said inner surface; and, d) a latch, including a latch foot having a flat foot undersurface and a latch post extending from said latch foot, reciprocally mounted in said second element and partially exposed from said inner surface of said second clamshell element, having a portion thereof positioned along said bore wall and biased for movement toward the interior thereof and having a plurality of transverse teeth formed along said flat foot undersurface portion of said latch, said latch further defined by a latch foot top surface, opposed side surfaces and a latch foot front surface all said latch foot surfaces defined by marginal edges meeting at their points of intersection, said latch arranged for slight upward movement against said bias during insertion of said stub in said bore, where said teeth on said stub pass over said teeth on said latch, for later interlocking mating engagement when said first and second clamshell elements are positioned on opposite sides of the trigger and surrounding trigger guard and said stub is passed between the trigger and the trigger guard of the firearm and inserted in said bore to allow said teeth on said latch to engage said teeth on said stub; and, e) a cover over said exposed portion of said latch, wherein said cover comprises:

i) a main planar cover plate defined by a pair of spaced-apart side edges for receipt in spaced-apart slots formed in said second clam shell element inner surface, a top edge and a bottom edge having a central cut-out portion formed therein; and, ii) a shield plate extending outward from above said cut-out portion and downward to shield said latch foot from being pried upward and out of contact with said stub.

* * * * *